United States Patent [19]

Hashimoto et al.

[11] 4,288,068

[45] Sep. 8, 1981

[54] SHEET FEEDING DEVICE

[75] Inventors: Hideo Hashimoto, Yokohama; Tokuzo Kaneda, Tokyo, both of Japan

[73] Assignee: Ricoh Co., Ltd., Japan

[21] Appl. No.: 146,089

[22] Filed: May 2, 1980

[30] Foreign Application Priority Data

May 14, 1979 [JP] Japan ..... 54-62938[U]

[51] Int. Cl.[3] ..... B65H 3/52

[52] U.S. Cl. ..... 271/125

[58] Field of Search ..... 271/104, 125, 124, 121, 271/122, 137

[56] References Cited

U.S. PATENT DOCUMENTS 3,635,465 1/1972 Beery ..... 271/122

4,232,860 11/1980 Brown ..... 271/125 X

*Primary Examiner*—Richard A. Schacher

*Attorney, Agent, or Firm*—McGlew and Tuttle

[57] ABSTRACT

A sheet feeding device including a sheet separating mechanism consisting of a feeding member and a braking separating member for preventing feeding of a plurality of sheets, and a speed adjusting mechanism for varying as desired the sheet feeding speed. The spacing between the feeding member and the braking separating member is determined based on a predetermined sheet feeding speed, and the sheet conveying force exerted by the feeding member is set at a level higher than the sheet arresting force exerted by the braking separating member. A supporting member for journalling at least one of the feeding member and the braking separating member and being movable for movement of one member toward the other member, and a transmission for moving the supporting member in synchronism with the movement of an adjusting member of the speed adjusting mechanism are provided, to vary the spacing between the feeding member and the braking separating member in accordance with a change in the sheet feeding speed.

7 Claims, 3 Drawing Figures

5
5a
6
6a
ℓ
4
5
6
7
8
9
10
11
11a
12
12a
13
14
15
16
17
18
19

SHEET FEEDING DEVICE

BACKGROUND OF THE INVENTION

This invention relates to a sheet feeding device for a copying apparatus or a printing apparatus.

One type of sheet feeding device known in the art comprises a sheet feeding member operative to come into contact with the uppermost sheet of a stack of sheets, and sheet separating means disposed downstream of the sheet feeding member with respect to the sheet feeding direction for separating the uppermost sheet from the second and following sheets when a plurality of sheets are inadvertently fed by the sheet feeding member.

In most of the sheet feeding devices of the aforesaid type, the sheet separating means generally comprises a pair of separating members, one of them is constructed as a feeding member rotating in a direction in which the sheets are fed, and the other is constructed as a braking members rotating in a direction opposite to the sheet feeding direction. Generally, in the sheet separating means of this construction, the spacing between the feeding member and the braking member is determined in such a manner that the spacing allows only one sheet to pass therethrough when the sheet feeding speed is at a predetermined level. Also, the coefficient of friction of the separating members with respect to the sheets or the ratio of the peripheral velocity of one separating member to the peripheral velocity of the other separating member is selected such that the feeding member exerts a higher sheet conveying force than the sheet arresting force exerted by the braking member.

In the case of a copying apparatus of the diazo type, however, wherein the sheet conveying speed can be varied, the difference between the sheet conveying force exerted by the feeding member of the sheet feeding device and the sheet arresting force exerted by the braking member would increase when the sheet feeding speed becomes higher than the predetermined level. That is, as the velocity of the feeding member and the velocity of the braking member increase at the same rate, the difference between their velocities would become greater. With the spacing between the feeding member and the braking member being constant, this increase in the difference between the two velocities would result in an increase in the sheet feeding speed over the predetermined level of sheet feeding speed, thereby causing the sheet conveying force exerted by the feeding member to become inordinately higher than the sheet arresting force exerted by the braking member. Thus when a plurality of sheets are inadvertently fed by the sheet feeding member, the sheets would be fed without being separated by the sheet separating means. Conversely, when the sheet feeding speed became lower than the predetermined level, the difference between the sheet conveying force exerted by the feeding member and the sheet arresting force exerted by the braking member would become small, so that the sheet arresting force exerted by the braking member would become inordinately high as compared with the sheet conveying force exerted by the feeding member. Thus the sheets would stop at the sheet separating means and no sheets could be fed to the printing station.

The aforementioned disadvantages can be obviated if the spacing between the feeding member and the braking member is adjusted by means of an adjusting mechanism each time the sheet feeding speed is varied. However, spacing adjusting is a time-consuming operation because the adjusting mechanism of the prior art is manually operated and has to be fixed each time adjustment is effected.

SUMMARY OF THE INVENTION

This invention has as its object the provision of a sheet feeding device suitable for use in a copying apparatus having a mechanism for varying the sheet feeding speed as desired which is provided with sheet separating means capable of effecting correct feeding of one sheet after another without feeding a plurality of sheets at a time or causing jamming of the sheets throughout the sheet feeding speed range.

According to the present invention, there is provided a sheet feeding device comprising, a sheet feeding member maintained in contact with the uppermost sheet of a stack of sheets for feeding one sheet after another, sheet separating means including a pair of separating members comprising a feeding member for exerting a sheet conveying force on a sheet, and a braking separating member exerting a sheet arresting force on a sheet to stop the movement thereof or forcing same to move backwardly, said separating members being located downstream of said sheet feeding member with respect to the sheet feeding direction, a speed adjusting mechanism including an adjusting member for suitably adjusting the sheet feeding speed, a supporting member for journalling at least one of said feeding member and said braking separating member for movement toward or away from the other separating member; and transmission means operative to move said supporting member in synchronism with the movement of said adjusting member of said speed adjusting mechanism to vary the spacing between said feeding member and said braking separating member.

In this specification, the term "sheet feeding speed" means a speed of the sheet fed between the feeding member and the braking separating member.

Additional and other objects, features and advantages of the invention will become apparatus from the description set forth hereinafter when considered in conjunction with the accompanying drawings.

DETAILED DESCRIPTION OF THE PREFERRED EMBODIMENTS

Figure 1:
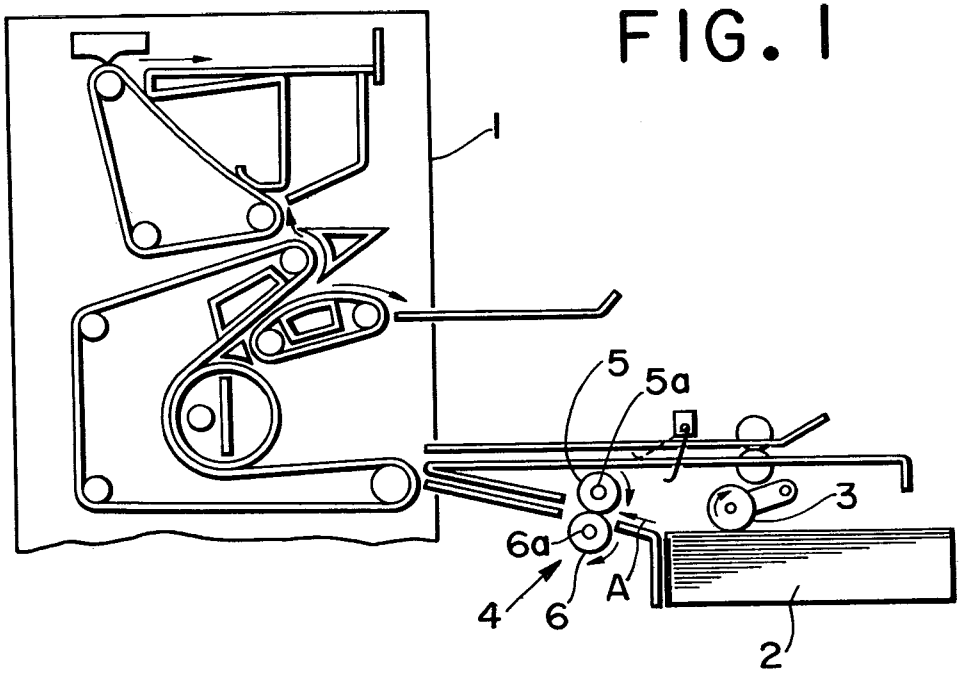
FIG. 1 is a schematic view of the sheet feeding device according to the invention as applied to a copying apparatus of the diazo type.

Referring to FIG. 1, the reference numeral 1 designates a diazo-type copying apparatus incorporating a sheet feeding device according to the invention which is shown on an enlarged scale to facilitate the clear understanding of the invention. The numeral 2 designates a stack of sheets which are photosensitive sheets in the embodiment shown. A sheet feeding member 3, in the form of sheet feeding rollers, is in contact with the uppermost sheet of the stack of sheets 2 and operative to feed the sheets along a feed part in the direction of an arrow A, when rendered operative. Sheet separating means 4 is located downstream of the sheet feeding member 3 with respect to the direction in which the sheets are fed.

Figures 2, 3:
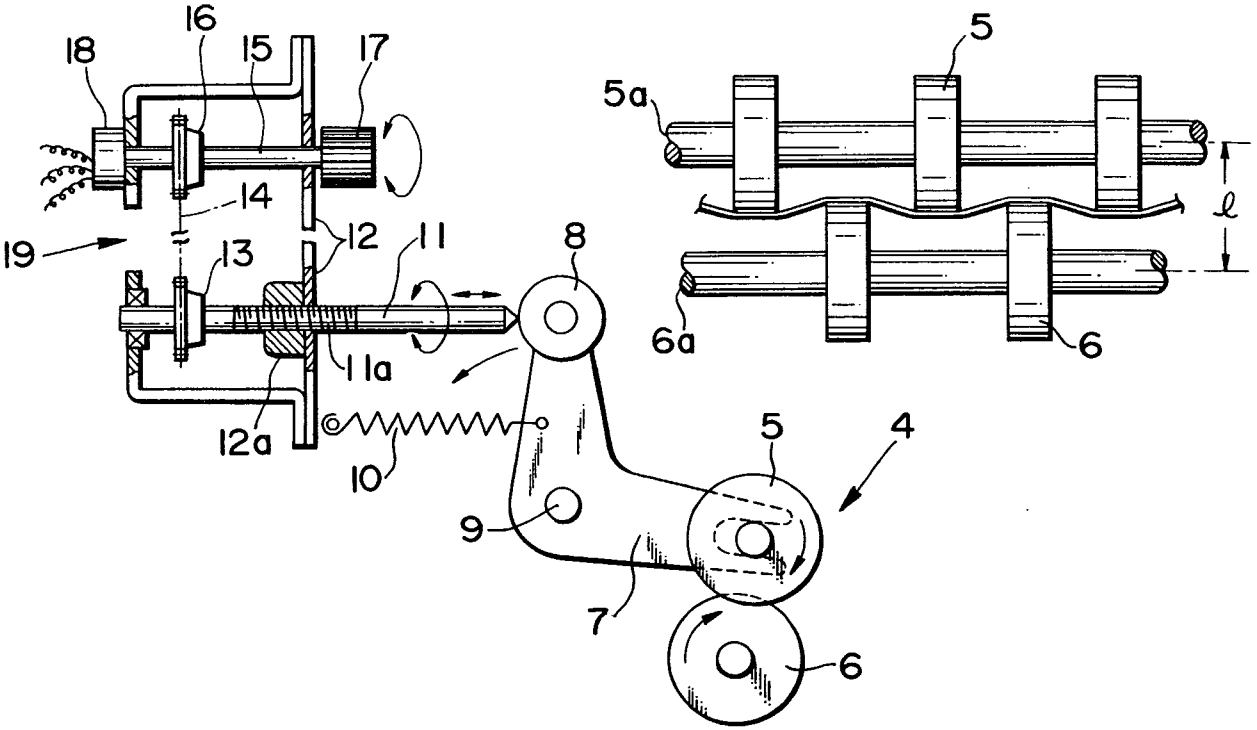
FIG. 2 is a schematic view of the sheet separating means according to the invention.
FIG. 3 is a front view of the feeding member and the braking separating member of the sheet separating means according to the invention.

The sheet separating means 4 comprises a feeding member, in the form of feeding rollers 5 rotating in a sheet feeding direction, and disposed at a higher position, and a braking separating member, in the form of braking rollers 6, similarly rotated effect a reverse-direction arresting force and disposed at a lower position. As shown in FIG. 3, the feeding rollers 5 and the braking rollers 6 are supported by a rotary shift 5*a* and a rotary shaft 6*a*, respectively, in such a manner that the rollers 5 and 6 are offset. The feeding rollers 5 exert a sheet conveying force which is set at a higher level than the sheet arresting force exerted by the braking roller 6, and the sheet feeding members 3, feeding rollers 5 and braking rollers 6 are each capable of having the rotational speed varied by a speed adjusting mechanism subsequently to be described.

Referring to FIG. 2, the feeding rollers 5 are journalled on one end of a supporting member, in the form of a pivotal lever arm 7 which supports a roller 8 at the other end thereof. The braking rollers 6 are rotatably supported and remain stationary. The pivotal lever arm 7 is pivotally supported by a shaft 9, and a tension spring 10 secured at one end to a stationary part, not shown, is connected at the other end to a portion of the arm 7 midway between the roller 8 and the shaft 9. Thus the pivotal arm 7 is normally urged by the biasing force of the spring 10 to move counterclockwise in pivotal motion about the shaft 9. The pivotal arm 7 remains stationary as the roller 8 abuts against a rod 11 subsequently to be described.

The speed adjusting mechanism comprises a variable resistor 18 for controlling a drive motor, not shown, which is supported at one end of a rod 15 which projects at the other end out of a machine frame 12 of the copying apparatus 1 and supports a speed adjusting member in the form of a dial 17. By manipulating the dial 17, it is possible to vary as desired the rotational speed of the drive motor for driving the sheet feeding rollers members 3, the feeding and braking rollers 5 and 6 and a sheet feeding system in the copying apparatus 1. Thus by manipulating the dial 17 to adjust the speed adjusting mechanism, the pivotal arm 7 can be moved, via transmission means 19 presently to be described, in pivotal movement about the shaft 9.

The transmission means 19 comprises the rod 11 referred to hereinabove as having the roller 8 abutting against its forward end. The rod 11 includes a threaded portion 11*a* located substantially midway between its opposite ends and threadably connected to the machine frame 12. A nut 12*a* secured to the machine frame 12 guides the axial movement of the rod 11 having secured thereto a sprocket 13 having a chain 14 trained over it and another sprocket 16 secured to the rod 15 for transmitting the rotation of the dial 17 to the rod 11. Gears, timing belts and other suitable power transmission means may be used in place of the sprockets and chain assembly.

Operation of the constructional form of the invention will now be described. The center-to-center spacing l between the feeding rollers 5 and the braking rollers 6 of the sheet separating means 4 is set, as shown in FIG. 3, at a level which is enough to allow only one sheet to pass therethrough and too small for more than two sheets in overlapped relation to pass therethrough. The value l is determined empirically by taking into consideration the stiffness of the sheets, the spacing, the spacing between the rollers arranged coaxially and the rotational speed of the rollers. In the embodiment shown and described herein, the lowest sheet feeding speed is taken as the standard for determining the spacing l.

Upon the dial 17 being manipulated to increase the sheet feeding speed by the action of the variable resistor 18, the rotation of the dial 17 is transmitted from the rod 15 to the rod 11 via the sprocket 16, chain 14 and sprocket 13. The rotating rod 11 moves axially in a direction in which it pushes the roller 8 at its forward end or rightwardly in FIG. 2 as the threaded portion 11*a* of the rod 11 turns relative to the nut 12*a*. This causes the pivotal arm 7 to move clockwise about the shaft 9 in pivotal movement, so that the center-to-center spacing l between the rollers 5 and 6 is reduced. Thus an increase in sheet feeding speed does not result in an increase in the sheet conveying force of the feeding rollers 5 to an inordinately high level because a reduction in the center-to-center spacing l increases the sheet arresting force of the rollers 6, thereby ensuring that feeding of more than two sheets is prevented.

By the constructional form of the invention described hereinabove, feeding of a plurality of sheets to the printing station can be positively prevented and sheet feeding can be carried out correctly in the entire range of sheet feeding speeds in a sheet feeding device capable of varying the sheet feeding speed used, for example, in a diazo-type copying apparatus, because the center-to-center spacing l between the feeding rollers and the braking rollers of the sheet separating means can be suitably adjusted automatically as sheet feeding speed is varied by manipulating the speed adjusting member or dial to maintain the ratio of the sheet conveying force exerted by the feeding rollers to the sheet arresting force exerted by the reverse rotation rollers at a predetermined suitable level.

It is to be understood that the invention is not limited to the specific form of embodiment described. For example, the sheet feeding member, feeding member and braking separating member may be of any form other than rollers, and they may be in the form of endless belts, for example. The braking separating member may be in the form a disc brake. The braking separating member may be journalled by the supporting member in such a manner that it is movable toward and away from the feeding member. The feeding member and the braking separating member may be supported by separate supporting members in such a manner that they are movable toward and away from each other. The invention can have application not only in a sheet feeding device for a diazo-type copying apparatus but also in any other sheet feeding device for a copying apparatus and printing apparatus capable of varying the sheet feeding speed as desired.

What is claimed is:

1. A sheet feeding device comprising:

a sheet feeding member maintained in contact with the uppermost sheet of a stack of sheets for feeding one sheet after another in a sheet feeding direction;

sheet separating means including a pair of separating members comprising a feeding member for exerting a sheet conveying force on a sheet, and a braking separating member exerting a sheet arresting force on a sheet to stop the movement thereof or forcing same to move oppositely to the sheet feeding direction, said separating members being located downstream of said sheet feeding member with respect to the sheet feeding direction;

a speed adjusting mechanism including an adjusting member for suitably adjusting the sheet feeding speed;

a supporting member for journalling at least one of said feeding member and said braking separating member for movement toward or away from the other separating member; and transmission means operative to move said supporting member in synchronism with the movements of said adjusting member of said speed adjusting mechanism to vary the spacing between said feeding member and said braking separating member.

2. A sheet feeding device as claimed in claim 1, wherein one of said feeding member and said braking separating member is journalled by said supporting member and the other member is fixed in position.

3. A sheet feeding device as claimed in claim 1, wherein said supporting member includes two supporting members, and each of said supporting members journals one of said feeding member and said braking separating member.

4. A sheet feeding device as claimed in claim 1, wherein said feeding member includes a first rotary shaft and a plurality of feeding rollers mounted in spaced locations on said first rotary shaft, and said braking separating member includes a second rotary shaft and a plurality of braking rollers mounted in spaced locations along said second rotary shaft, and each of said braking rollers being disposed intermediate adjacent feeding rollers.

5. A sheet feeding device as claimed in claim 4 wherein said supporting member includes a shaft, a lever arm pivotally mounted on the shaft, a spring connected to said lever arm for resiliently biasing one of said feeding member and said braking separating member.

6. A sheet feeding device as claimed in claim 5 wherein said speed adjusting mechanism includes a frame, and means mounted to said frame for varying said feeding speed of said sheet feeding means, and wherein said transmission means includes a rod rotatably mounted to said frame in communication with said lever arm, and drive means operatively interconnecting said rod and said varying means.

7. A sheet feeding device comprising:

sheet feeding means for successively feeding each sheet of a stack of sheets in a sheet feeding direction along a feed path;

sheet separating means including a pair of separating members disposed along the feed path for separating sheets in a spacing therebetween comprising, feeding member for exerting a sheet conveying force on a sheet, and a braking separating member exerting a sheet arresting force on a sheet to stop the movement thereof or forcing same to move oppositely of the sheet feeding direction, said separating members being located downstream of said sheet feeding means with respect to the sheet feeding direction;

speed adjusting means for suitably adjusting the sheet feeding speed;

supporting means for supporting at least one of said feeding member and said braking separating member for movement toward or away from the other member; and transmission means operative to move said supporting means in synchronism with the movement of said adjusting means to vary the spacing between said feeding member and said braking separating member.

* * * * *